US011802030B2

(12) United States Patent
Harajiri et al.

(10) Patent No.: US 11,802,030 B2
(45) Date of Patent: Oct. 31, 2023

(54) LIFTING DEVICE

(71) Applicant: TOYOTA JIDOSHA KABUSHIKI KAISHA, Toyota (JP)

(72) Inventors: Katsuji Harajiri, Toyota (JP); Kazuo Suyama, Tokyo (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 297 days.

(21) Appl. No.: 17/322,215

(22) Filed: May 17, 2021

(65) Prior Publication Data

US 2022/0033236 A1 Feb. 3, 2022

(30) Foreign Application Priority Data

Jul. 28, 2020 (JP) ..... 2020-127307

(51) Int. Cl.

| | |
|---|---|
| ***B66D 1/50*** | (2006.01) |
| ***B66D 1/36*** | (2006.01) |
| ***B66D 1/12*** | (2006.01) |

(52) U.S. Cl.

CPC ..... *B66D 1/505* (2013.01); *B66D 1/12* (2013.01); *B66D 1/36* (2013.01)

(58) Field of Classification Search

CPC ..... B66C 21/00; B66D 1/38; B66D 1/741; B66D 1/50; B66D 1/505; B66D 1/12; B66D 1/36

See application file for complete search history.

(56) References Cited

U.S. PATENT DOCUMENTS

2020/0305361 A1 10/2020 Suyama et al.

FOREIGN PATENT DOCUMENTS

| | | | |
|---|---|---|---|
| JP | S49-058054 | U | 5/1974 |
| JP | 2008-109918 | A | 5/2008 |
| JP | 3162428 | U | 9/2010 |
| JP | 2011-219226 | A | 11/2011 |
| JP | 2020-162456 | A | 10/2020 |

*Primary Examiner* — Moshe Wilensky
(74) *Attorney, Agent, or Firm* — Oliff PLC

(57) ABSTRACT

The lifting device includes a first drum around which a wire is wound, a first motor that rotates the first drum, a second drum around which the wire fed from the first drum is wound, and a second motor that rotates the second drum. The first motor is driven to rotate the first drum so as to lift the wire, and the second motor is driven to rotate the second drum to lift the wire fed from the first drum.

8 Claims, 4 Drawing Sheets

30

LIFTING DEVICE

CROSS-REFERENCE TO RELATED APPLICATION

This application claims priority to Japanese Patent Application No. 2020-127307 filed on Jul. 28, 2020, incorporated herein by reference in its entirety.

BACKGROUND

1. Technical Field

The disclosure relates to a lifting device that lifts a wire.

2. Description of Related Art

Japanese Unexamined Patent Application Publication No. 2008-109918 (JP 2008-109918 A) discloses a timber conveyance system for conveying timber from forest thinning from a logging position to an unloading position. The timber conveyance system above includes a tower yarder disposed in proximity to the unloading position on a work road, a first winch that is provided in the tower yarder and winds a first wire, a second winch that is provided in the tower yarder and winds a second wire, a plurality of pulleys that is connected in the middle of a traveling path of the second wire and converts a traveling direction of the second wire, a loading tool that loads the timber, and a plurality of zigzag pulleys that is connected in the middle of a traveling path of the loading tool and converts a traveling direction of the loading tool.

SUMMARY

In the technique described in JP 2008-109918 A, the wire is lifted by a winch. However, when a length of the wire to be lifted is long, the wire may be lifted by the winch in multiple layers. When a tension of the wire is large when the wire is lifted in multiple layers, the wire may bite into a gap of the wire in a lower layer, which may cause tightening.

An object of the disclosure is to provide a technique for suppressing occurrence of tightening of the wire that is lifted.

In order to solve the issue above, a lifting device according to an aspect of the disclosure includes: a first drum around which a wire is wound; a first motor that rotates the first drum; a second drum around which the wire fed from the first drum is wound; and a second motor that rotates the second drum. The first motor is driven to rotate the first drum so as to lift the wire, and the second motor is driven to rotate the second drum so as to reel the wire fed from the first drum.

According to the disclosure, it is possible to provide a technique for suppressing the occurrence of tightening of the wire that is lifted.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Figure 1:
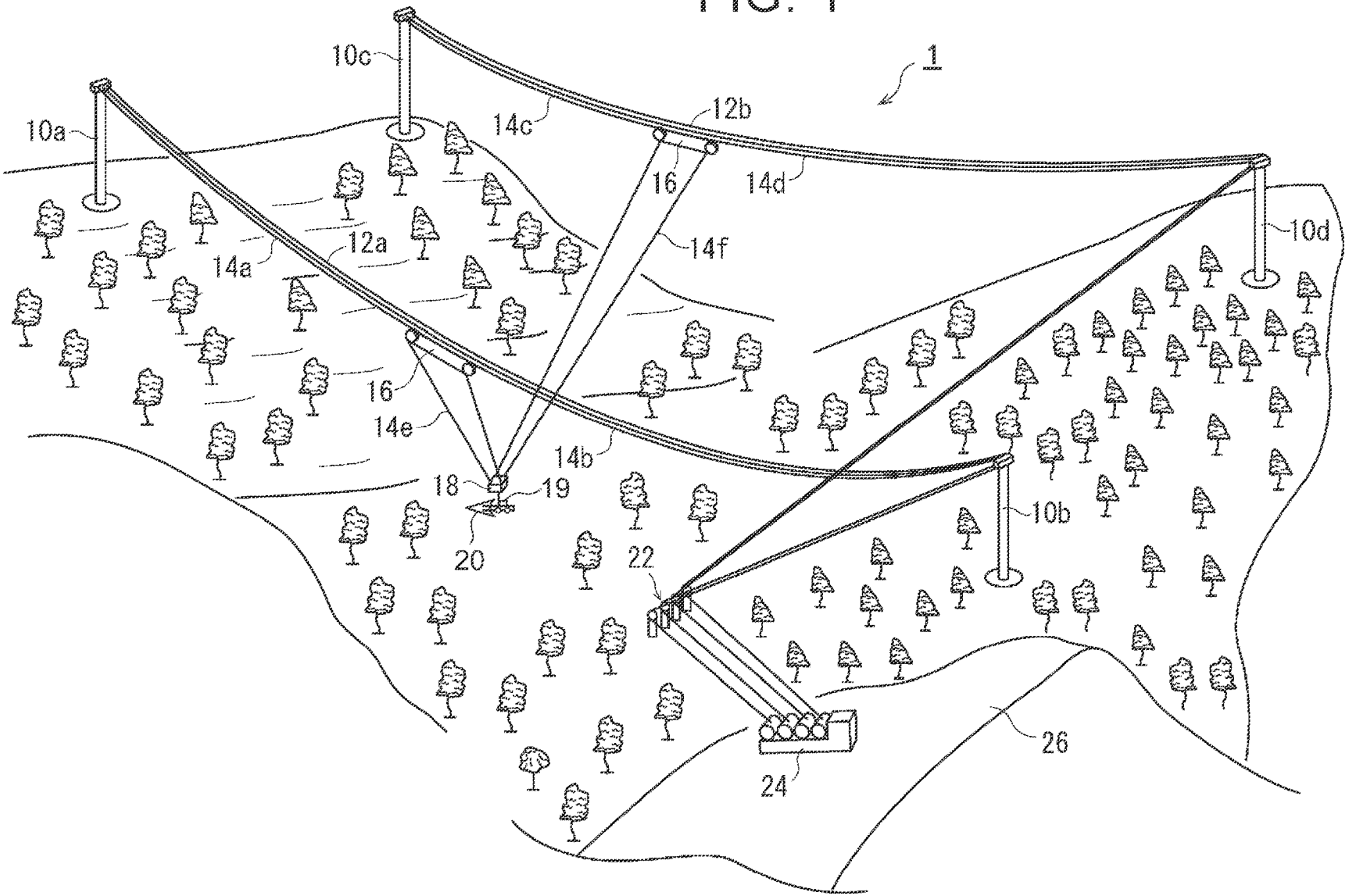
FIG. 1 is a diagram for describing an overhead line utilization system.

FIG. 1 is a diagram for describing an overhead line utilization system 1. The overhead line utilization system 1 includes a first support post 10*a*, a second support post 10*b*, a third support post 10*c*, a fourth support post 10*d* (when the support posts are not distinguished, each support post is referred to as a "support post 10"), a first main rope 12*a*, a second main rope 12*b* (when the main ropes are not distinguished, each main rope is referred to as a "main rope 12"), a first work rope 14*a*, a second work rope 14*b*, a third work rope 14*c*, a fourth work rope 14*d*, a fifth work rope 14*e*, a sixth work rope 14*f* (when the work ropes are not distinguished, each work rope is referred to as a "work rope 14"), a first moving device 16*a*, a second moving device 16*b* (when the moving devices are not distinguished, each moving device is referred to as a "moving device 16"), a suspension device 18, guide pulleys 22, and a lifting device 24.

The overhead line utilization system 1 is a so-called H-type system using the overhead line. The overhead line utilization system 1 is used to lift a tree 20 logged in a forest using the main ropes 12 and the work ropes 14 stretched in the air and convey the tree 20 to the vicinity of a collecting place 26. This allows the tree 20 to be conveyed from the forest without creating roads.

The four support posts 10 are erected at positions suitable for erection determined based on an arrangement of standing trees and a position of the collecting place 26. The support posts 10 are each set to a size of, for example, about five meters to ten meters, depending on the size of the overhead line utilization system 1, etc.

The main ropes 12 and the work ropes 14 are fixed to the support posts 10 as the overhead lines or hung on the pulleys of the support posts 10. The first main rope 12*a* is fixed to the first support post 10*a* and the second support post 10*b*, and the second main rope 12*b* is fixed to the third support post 10*c* and the fourth support post 10*d*. The first main rope 12*a* and the second main rope 12*b* function as rails in the air. The first main rope 12*a* and the second main rope 12*b* are provided so as not to intersect with each other. A length of the main rope 12 is about 300 to 1500 meters.

The work rope 14 functions as a running rope lifted by the moving device 16 or the lifting device 24. The first work rope 14*a*, the second work rope 14*b*, the third work rope 14*c*, and the fourth work rope 14*d* are each hung on a pulley provided for the corresponding support post 10, and each have one end connected to the moving device 16, and the other end connected to the lifting device 24. The first work rope 14*a* is stretched from the lifting device 24 and connected to the first moving device 16*a* via the second support post 10*b* and the first support post 10*a*. The second work rope 14*b* is stretched from the lifting device 24 and connected to the first moving device 16*a* via the second support post 10*b*. The third work rope 14*c* is stretched from the lifting device 24 and connected to the second moving device 16*b* via the fourth support post 10*d* and the third support post 10*c*. The fourth work rope 14*d* is stretched from the lifting device 24 and connected to the second moving device 16*b* via the fourth support post 10*d*. The fifth work rope 14*e* and the sixth work rope 14*f* are connected to the moving devices 16 and the suspension device 18.

A pair of the moving devices 16 is supported by a pair of the main ropes 12, and can move in the air along the main ropes 12. The first work rope 14*a*, the second work rope 14*b*, and the fifth work rope 14*e* are connected to the first moving device 16*a*, and the third work rope 14*c*, the fourth work rope 14*d*, and the sixth work rope 14*f* are connected to the second moving device 16*b*. The fifth work rope 14*e* connects the first moving device 16*a* and the suspension device 18, and the sixth work rope 14*f* connects the second moving device 16*b* and the suspension device 18. The moving devices 16 have a function of lifting and lowering the fifth work rope 14*e* and the sixth work rope 14*f* in response to a wireless command signal.

The suspension device 18 has an elevating wire rope and a grip device 19 that is provided at a tip end of the elevating wire rope. The grip device 19 grips the tree 20 and cuts the tree 20 in a state where the grip device 19 grips the tree 20. The suspension device 18 is lowered to grip the tree 20, lifted to convey the tree 20, and lowered to unload the tree 20. A device suspended from the suspension device 18 is not limited to the grip device 19. The device suspended from the suspension device 18 may be a monitoring device that monitors the periphery of the tree 20 and an inspection device that detects a position and a condition of the tree 20, etc., and may be replaceable. In any case, the work rope 14 is provided with a device that moves in the air.

The guide pulleys 22 change the direction of the work ropes 14 that are hung. The lifting device 24 functions as a winch for lifting each of the work ropes 14, and includes a drum for lifting or lowering each of the work ropes 14 and a drive source.

Operations of the overhead line utilization system 1 will be described. The lifting device 24 lifts one of the first work rope 14*a* and the second work rope 14*b* and lowers the other such that the first moving device 16*a* is moved along the first main rope 12*a*. The lifting device 24 lifts one of the third work rope 14*c* and the fourth work rope 14*d* and lowers the other such that the second moving device 16*b* is moved along the second main rope 12*b*. With the processing above, the suspension device 18 is displaced along the main ropes 12.

The moving devices 16 lift one of the fifth work rope 14*e* and the sixth work rope 14*f* and lowers the other such that the suspension device 18 moves between the first moving device 16*a* and the second moving device 16*b*. With the processing above, the suspension device 18 can move horizontally in an area surrounded by the four support posts 10.

As described above, the lifting device 24 and the moving devices 16 wind the work ropes 14 (wires) such that the suspension device 18 and the grip device 19 are movable in the air in the horizontal direction. In the mode of the overhead line utilization system 1 shown in FIG. 1, the moving devices 16 that lift the fifth work rope 14*e* and the sixth work rope 14*f* are connected to the main ropes 12. However, the mode of the overhead line utilization system 1 is not limited to this, and a lifting function of the moving devices 16 can be integrated into the lifting device 24 when the fifth work rope 14*e* and the sixth work rope 14*f* are extended to a position of the lifting device 24.

In FIG. 1, the lifting device 24 is provided with a plurality of drums such that the work ropes 14 are liftable. However, the drum may be provided separately for each work rope 14. That is, the lifting device 24 is provided for each support post 10 with respect to the corresponding work rope 14.

Figure 2:
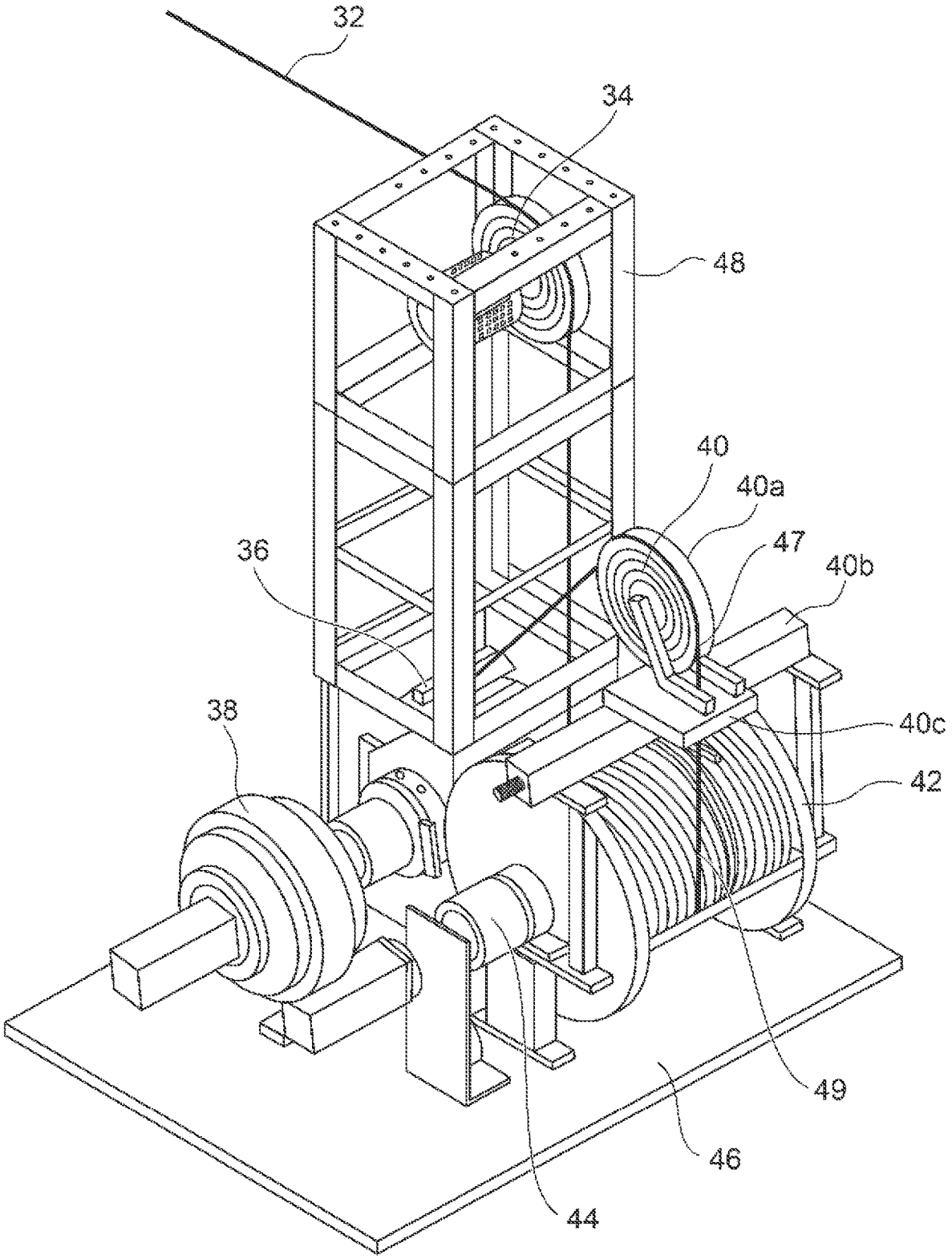
FIG. 2 is a perspective view of a lifting device.
Figure 3:
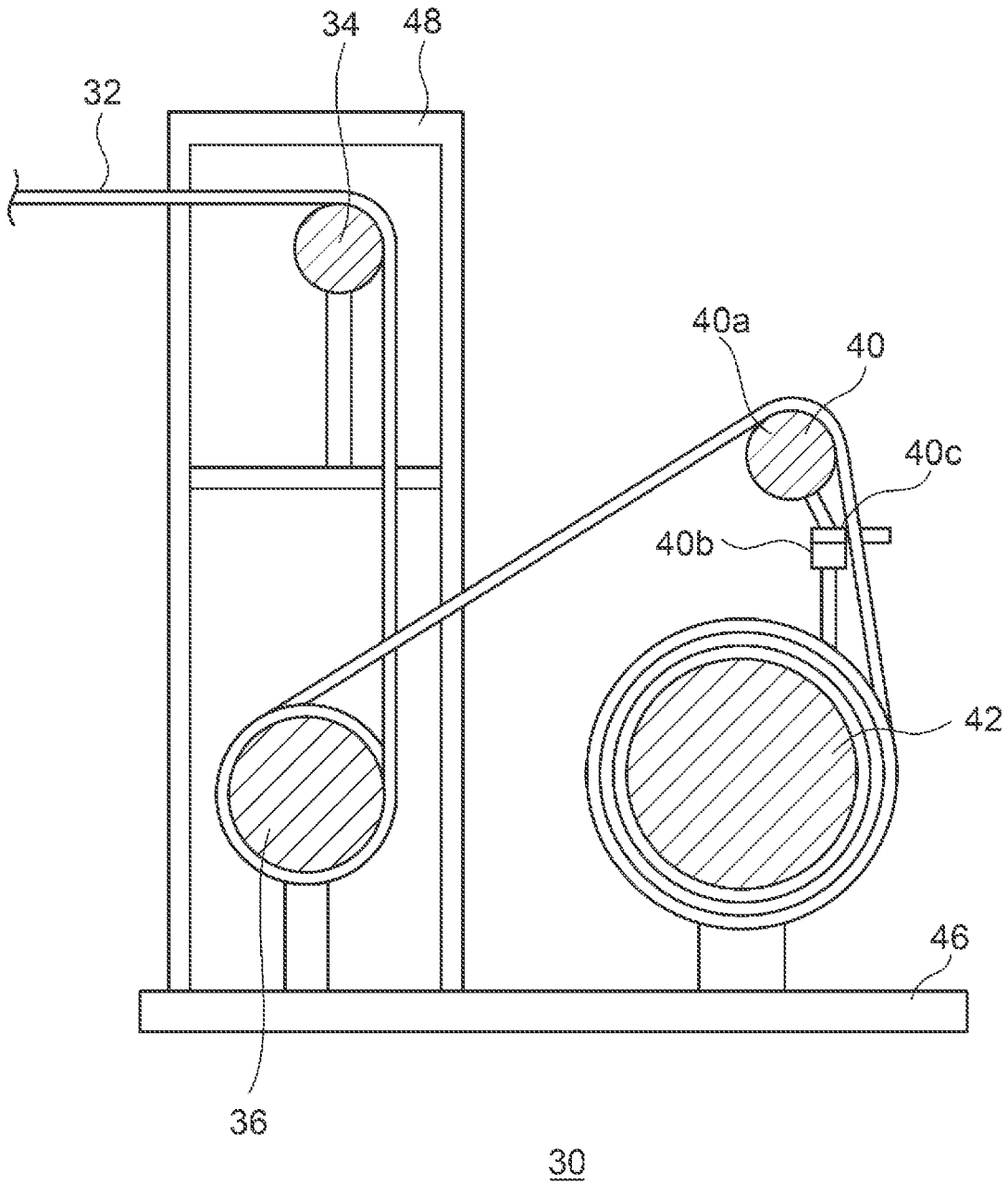
FIG. 3 is a view showing the lifting device as viewed in a side view.

FIG. 2 is a perspective view of the lifting device 30. Further, FIG. 3 shows the lifting device 30 as viewed in a side view. The lifting device 30 includes a wire 32, a pulley 34, a first drum 36, a first motor 38, a traverser 40, a second drum 42, a second motor 44, a pedestal 46, and a support post 48. The lifting device 30 is different from the lifting device 24 shown in FIG. 1 in that the lifting device 30 is provided separately for each of the work ropes 14. However, as shown with the lifting device 24, the lifting devices 30 may be integrated such that the work ropes 14 can be collectively reeled.

The wire 32 corresponds to the work rope 14 when used in the overhead line utilization system 1. When the wire 32 is used in the overhead line utilization system 1, the wire 32 has a length of about 200 meters to 2000 meters, and the lifting device 30 is provided such that the lifting device 30 can reel the wire 32 having a maximum length of about 2000 meters. Therefore, the lifting device 30 reels the wire 32 in multiple layers. However, when a high tension, for example, a tension equal to or more than 1000 Newton, is generated with the wire 32, tightening may occur. The wire 32 reeled in multiple layers may bite into a gap in the wire 32 on an inner layer side due to occurrence of tightening. This may cause deformation of the wire and cause a difficulty to unreel the wire 32. Therefore, the lifting device 30 according to the embodiment includes two drums for reeling the wire 32 having low tension in multiple layers so as to suppress occurrence of tightening. The lifting device 30 may be used for a large-size crane and a ship, etc.

The pulley 34 is provided in an upper portion of the support post 48. The wire 32 is hung on the pulley 34 and the pulley 34 guides the wire 32 to the first drum 36 by changing the direction of the wire 32. In the overhead line utilization system 1, the support post 48 may support the work rope 14 extending from the support post 10, or may be the support post 10.

The first drum 36 is provided below the pulley 34, lifts the wire 32 extending from the pulley 34, and feeds the wire 32 to the second drum 42. The wire 32 is wound on the first drum 36 multiple times. However, the first drum 36 reels the wire 32 in a single layer instead of the multiple layer. The number of turns of the wire 32 on the first drum 36 is set through an experiment, etc., and is set such that the tension of the wire 32 fed to the second drum 42 is equal to or less than a predetermined reference value. The predetermined reference value is set to, for example, 1000 Newton. For example, in the overhead line utilization system 1 provided with the wire 32 of 1000 meters, the wire 32 is wound around the first drum 36 about 10 times. The predetermined reference value is not limited to 1000 Newton.

The first motor 38 can rotate the first drum 36 to lift and lower the wire 32. The tension of the wire 32 wound on the first drum 36 becomes significantly high. Therefore, an output from the first motor 38 becomes accordingly high.

The wire 32 fed out from the first drum 36 is connected to the traverser 40 and fed from the traverser 40 to the second drum 42. The traverser 40 includes a pulley portion 40*a*, a rail portion 40*b*, and a slide portion 40*c*.

The wire 32 fed from the first drum 36 is hung on the pulley portion 40*a*, and the pulley portion 40*a* guides the wire 32 to the second drum 42. The rail portion 40*b* extends parallel to a rotation axis direction of the second drum 42 and is provided above the second drum 42. The slide portion 40*c* supports the pulley portion 40*a* and is slidable along the rail portion 40*b*. With this configuration, the pulley portion 40*a* can slide in a direction perpendicular to a direction in which the wire 32 extends toward a position where the second drum 42 reels the wire 32.

A position 47 of the wire 32 extending from the pulley portion 40*a* as the pulley portion 40*a* slides and a position 49 at which the second drum 42 reels the wire 32 (reeling position) can be aligned in an up-down direction, and the second drum 42 reels the wire 32 in a state where the wire 32 is vertically straight. The position 47 of the wire 32 extending from the pulley portion 40*a* is displaced along the rotation axis direction of the second drum 42 as the pulley portion 40*a* slides, and the reeling position 49 of the second drum 42 is displaced along the rotation axis direction in accordance with alignment of turns of the wire 32. The pulley portion 40*a* can guide the wire 32 by sliding in accordance with the reeling position 49 of the second drum 42, which makes it possible to suppress twisting of the wire 32 reeled by the second drum 42. The traverser 40 aligns the wires 32 layer by layer for the second drum 42 to lift the wire 32.

The second drum 42 reels the wire 32 fed from the first drum 36 via the traverser 40. The wire 32 wound around the second drum 42 is wound in multiple layers and held by the second drum 42. The second motor 44 can rotate the second drum 42 to lift and lower the wire 32. The second motor 44 may have a braking function to stop lifting and lowering of the wire 32. A control device (not shown) controls driving of the first motor 38 and the second motor 44.

The tension of the wire 32 fed from the first drum 36 decreases in accordance with the number of turns of the wire 32 on the first drum 36 as compared with the tension of the wire 32 before the wire 32 is lifted by the first drum 36. This is because the tension of the wire 32 is changed to a force that tightens the wire 32 in an inner diameter direction each time the wire 32 is wound around the first drum 36.

The first drum 36 winds the wire 32 having high tension to feed the wire 32 having low tension, and the second drum 42 lifts the wire 32 having low tension. That is, the first drum 36 has a function of reducing the tension of the wire 32, and the second drum 42 has a function of accommodating the wire 32. The first motor 38 lifts the wire 32 having a relatively high tension. Therefore, an output from the first motor 38 becomes higher than that of the second motor 44.

The wire 32 is wound around the first drum 36 in a single layer, and the wire 32 is wound around the second drum 42 in multiple layers. With this configuration, the first drum 36 feeds the wire 32 having low tension to the second drum 42. Therefore, occurrence of tightening can be suppressed even when the wire 32 is wound in multiple layers.

The pulley portion 40*a* of the traverser 40 is located above the second drum 42 and is provided at a position closer to the second drum 42 than the first drum 36. That is, a rotation center of the pulley portion 40*a* is provided at a position closer to a rotation center of the second drum 42 than a rotation center of the first drum 36. With this configuration, the wire 32 can be fed from a position close to the second drum 42 along a direction in which the second drum 42 lifts the wire 32, which makes it possible to stably align the wire 32. Further, when viewed from the rotation axis direction shown in FIG. 3, the pulley portion 40*a* of the traverser 40 is disposed at a position where the pulley portion 40*a* overlaps with the second drum 42 in the up-down direction, which makes it possible to reduce a bending angle of the wire 32, compared with a case where the pulley portion 40*a* is disposed at a position away from the second drum 42 toward the right side in FIG. 3.

As shown in FIG. 3, the wire 32 is bent by the pulley 34, the first drum 36, the traverser 40 and the second drum 42. When viewed in the rotation axis direction shown in FIG. 3, bending directions of the wires 32 are all clockwise direction and are bent in the same direction. The wire 32 is bend in the same direction at the pulley 34, the first drum 36, the traverser 40, and the second drum 42 such that deterioration of the wire 32 can be suppressed.

Each component of the lifting device 30 is fixed to the pedestal 46, thereby unitizing the lifting device 30. Further, the support post 10 used in the overhead line utilization system 1 is used as the support post 48, which makes it possible to configure the support post 10 and the drive source of the overhead line utilization system 1 using four units.

Figure 4:
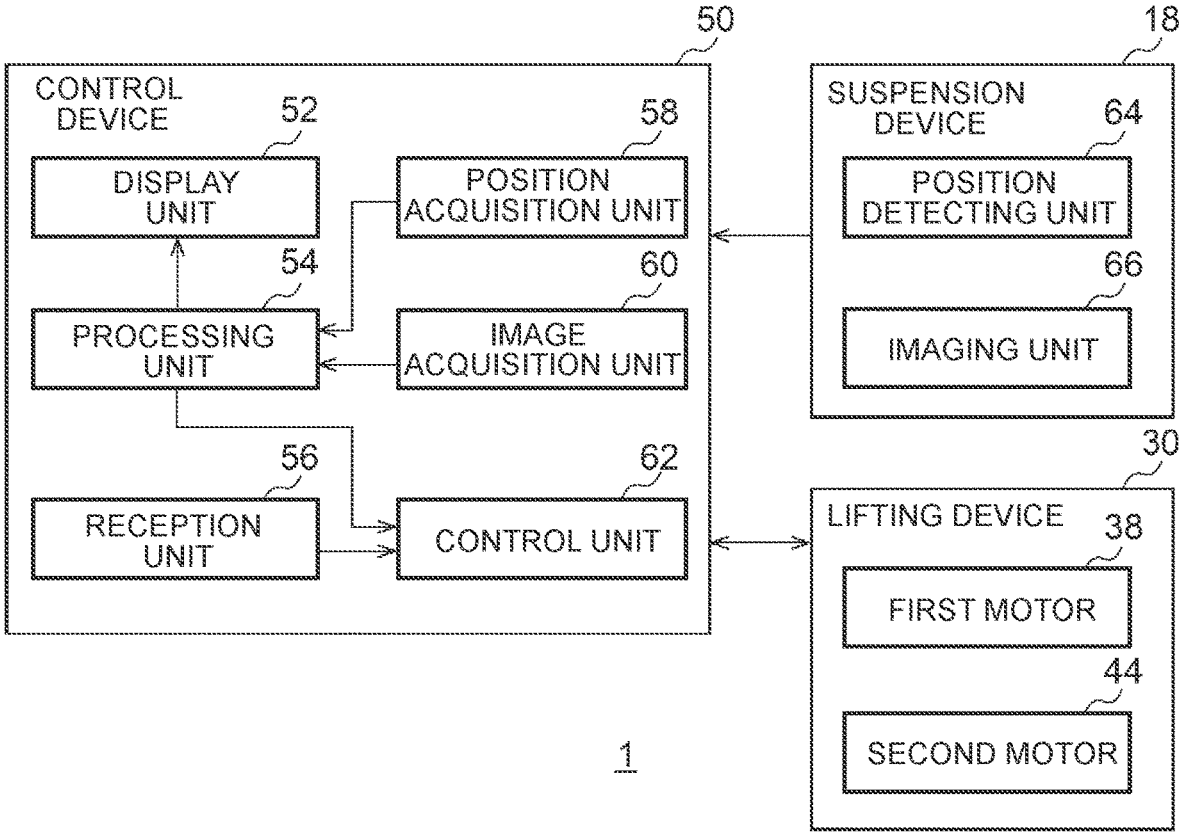
FIG. 4 shows a functional configuration of the overhead line utilization system.

FIG. 4 shows a functional configuration of the overhead line utilization system 1. The control device 50 is provided in a control room and can remotely control the suspension device 18 and the lifting device 30. The suspension device 18 and the lifting device 30 can wirelessly communicate with the control device 50. Although only one lifting device 30 is shown in FIG. 4, a plurality of the lifting devices 30 is actually provided corresponding to the work ropes 14, and the functional configuration of the lifting devices 30 is the same among each other. Therefore, the functional configurations of the other lifting devices 30 are omitted.

The suspension device 18 includes a position detecting unit 64 and an imaging unit 66. The position detecting unit 64 detects position information of the suspension device 18 using a satellite positioning system. The imaging unit 66 is a camera provided in the suspension device 18, mainly captures a lower portion of the suspension device 18, and detects a captured image including the grip device 19.

The first motor 38 and the second motor 44 of the lifting device 30 are remotely controlled by the control device 50 and driven in accordance with the control by the control device 50.

The control device 50 includes a display unit 52, a processing unit 54, a reception unit 56, a position acquisition unit 58, an image acquisition unit 60, and a control unit 62. The position acquisition unit 58 acquires position information of the suspension device 18 from the suspension device 18. The image acquisition unit 60 acquires captured images from the suspension device 18 and the grip device 19, respectively. The reception unit 56 is a touch panel or a mechanical controller, and receives operations by the operator.

The processing unit 54 generates a display image to be displayed on the display unit 52 based on the position information of the suspension device 18 and the captured images of the suspension device 18 and the grip device 19. The operator operates the lifting device 30 while visually checking the position information and the captured image of the suspension device 18 displayed on the display unit 52.

The control unit 62 controls the lifting device 30 based on operation information of the operator input to the reception unit 56. The control unit 62 drives the first motor 38 in accordance with a lifting amount of the wire 32 that is calculated based on the operation information. With this configuration, the wire 32 is lifted by the first drum 36 and fed to the second drum 42. The second motor 44 is driven with an output at which the tension of the wire 32 reeled by the second drum 42 becomes equal to or less than a predetermined reference value. For example, the second motor 44 applies rotational torque to the second drum 42 so as to pull the wire 32 at 1000 newtons. With this configuration, the wire 32 fed from the first drum 36 is reeled by the second drum 42.

The first motor 38 is rotated by an amount corresponding to a command signal of the control unit 62, and the second motor 44 is driven with a predetermined output in conjunction with driving of the first motor 38. The second motor 44 is driven with an output equal to or less than a predetermined value such that the tension of the wire 32 reeled by the second drum 42 becomes equal to or less than a predetermined reference value. The second motor 44 is driven with a preset output. The second motor 44 starts driving in accordance with the start of driving of the first motor 38, ends driving in accordance with the end of driving of the first motor 38, and interlocks with driving of the first motor 38. With this configuration, the second drum 42 can reel the wire 32 having a tension equal to or less than the reference value, which can suppress occurrence of tightening.

The rotation speed of the second motor 44 may be faster than that of the first motor 38. Further, when the wire 32 is lifted, the lifting amount of the second drum 42 per hour may be set to be larger than the lifting amount of the first drum 36 per hour. With this configuration, it is possible to suppress the wire 32 from remaining between the first drum 36 and the second drum 42.

A rotation detection sensor that detects a rotation amount of the first drum 36 or a rotation amount of the first motor 38 may be provided, and the control unit 62 may control the first motor 38 based on a detection result of the rotation detection sensor. Further, the control unit 62 may control the first motor 38 such that the suspension device 18 reaches a desired position based on the position information of the suspension device 18.

Further, the control unit 62 drives the first motor 38 in accordance with a lowering amount of the wire 32 that is calculated based on the operation information, and drives the second motor 44 in conjunction with the first motor 38.

The processing unit 54 generates the command information to move the suspension device 18 to a predetermined position based on the position information and the captured images of the suspension device 18. For example, the processing unit 54 generates the command information for moving the suspension device 18 to the position of the tree 20 to be logged. The processing unit 54 may have a program for calculating the lifting amount or the lowering amount of each of the work ropes 14 in accordance with a target position of the suspension device 18. The control unit 62 controls the lifting device 30 in accordance with the command information so as to move the suspension device 18 to a predetermined position. That is, the control of the lifting device 30 for moving the suspension device 18 may be executed based on the operation by the operator, or may be automatically executed by the processing unit 54.

The disclosure has been described above based on the embodiment. The embodiment is merely an example, and it is understood by those skilled in the art that various modifications are possible for each component and combination of the processing processes, and that such modifications are also within the scope of the disclosure.

For example, in the embodiment, the mode in which the traverser 40 slides along the rotation axis direction of the second drum 42 is shown. However, the disclosure is not limited to this mode. For example, the pulley portion 40*a* of the traverser 40 is attached to a hinge having a rotation axis along the up-down direction, and the hinge rotates in accordance with the reeling position 49 of the second drum 42 such that the pulley portion 40*a* faces the reeling position 49 of the second drum 42. When the pulley portion 40*a* is rotated by the hinge, the rotation axis of the pulley portion 40*a* is orthogonal to an extending direction of the wire 32 fed from the pulley portion 40*a*. With this configuration, the traverser 40 can change the direction of the wire 32 fed from the pulley portion 40*a* in accordance with the reeling position 49 of the second drum 42.

What is claimed is:

1. A lifting device, comprising:

a first drum around which a wire is wound;

a first motor that rotates the first drum;

a second drum around which the wire fed from the first drum is wound;

a second motor that rotates the second drum; and a traverser that supports the wire between the first drum and the second drum and guides the wire to the second drum, wherein the first motor is driven to rotate the first drum so as to lift the wire, and the second motor is driven to rotate the second drum so as to reel the wire fed from the first drum, and wherein the traverser is located immediately above the second drum and is provided at a position closer to the second drum than the first drum.

2. The lifting device according to claim 1, wherein the first motor has a higher output than an output of the second motor, and driving of the first motor is controlled in accordance with a command signal from a control device.

3. The lifting device according to claim 1, wherein the second motor is driven with an output at which a tension of the wire reeled by the second drum becomes equal to or less than a predetermined reference value.

4. The lifting device according to claim 1, wherein:

the wire is provided in a single layer around the first drum; and the wire is provided in multiple layers around the second drum.

5. The lifting device according to claim 1, wherein:

the wire is supported by a plurality of support posts and is connected to a predetermined device; and the wire is lifted or lowered so as to move the predetermined device in the air.

6. The lifting device according to claim 1, wherein:

the wire is bent by the first drum, the second drum, and the traverser; and a bending direction of the wire at the first drum, a bending direction of the wire at the second drum, and a bending direction of the wire at the traverser are the same rotational direction, when viewed in a rotation axis direction of the first drum.

7. The lifting device according to claim 1, further comprising a pulley that is located immediately above the first drum and supports the wire.

8. The lifting device according to claim 7, wherein:

the wire is bent by the first drum, the second drum, the traverser, and the pulley; and a bending direction of the wire at the first drum, a bending direction of the wire at the second drum, a bending direction of the wire at the traverser, and a bending direction of the wire at the pulley are the same rotational direction, when viewed in a rotation axis direction of the first drum.

* * * * *